US005467857A

United States Patent [19]

Takemoto

[11] Patent Number: 5,467,857

[45] Date of Patent: Nov. 21, 1995

[54] SLOT MACHINE HAVING UNITARY COIN RESTORATION SYSTEM

[75] Inventor: Takatoshi Takemoto, Tokyo, Japan

[73] Assignee: Kabushiki Kaisha Ace Denken, Tokyo, Japan

[21] Appl. No.: 256,837

[22] PCT Filed: Jan. 28, 1993

[86] PCT No.: PCT/JP93/00001

§ 371 Date: Jul. 28, 1994

§ 102(e) Date: Jul. 28, 1994

[87] PCT Pub. No.: WO93/14842

PCT Pub. Date: Aug. 5, 1993

[30] Foreign Application Priority Data

Jan. 28, 1992 [JP] Japan ..... 4-013397

[51] Int. Cl.[6] ..... G07F 17/34

[52] U.S. Cl. ..... 194/206; 194/343; 273/138 A; 453/17

[58] Field of Search ..... 194/206, 207, 194/217, 218, 343; 273/138 A; 453/17

[56] References Cited

U.S. PATENT DOCUMENTS

| | | | |
|---|---|---|---|
| 4,342,384 | 8/1982 | Fukase et al. . | |
| 5,067,928 | 11/1991 | Harris | 453/17 |
| 5,113,990 | 5/1992 | Gabrius et al. | 194/217 X |
| 5,366,407 | 11/1994 | Sentoku | 453/17 |

FOREIGN PATENT DOCUMENTS

| | | |
|---|---|---|
| 436050 | 7/1991 | European Pat. Off. . |
| 2532451 | 3/1984 | France . |
| 55-166287 | 11/1980 | Japan . |
| 60-31782 | 2/1985 | Japan . |
| 1-110786 | 7/1989 | Japan . |
| 1-201288 | 8/1989 | Japan . |
| 1-227783 | 9/1989 | Japan . |
| 1-317469 | 12/1989 | Japan . |
| 3-155884 | 7/1991 | Japan . |
| 4-5887 | 1/1992 | Japan . |

*Primary Examiner*—F. J. Bartuska
*Attorney, Agent, or Firm*—Lowe, Price, LeBlanc & Becker

[57] ABSTRACT

A slot machine comprising a game execution system for executing a game, a coin dispensing/adjustment system for dispensing coins and making adjustment, and a coin handling system is disclosed. The coin handling system comprises an internal hopper (1) for dispensing coins and holding coins taken in from the outside and a coin storage tank (2) having a capacity larger than that of the internal hopper (1). It further includes an adjustment mechanism for moving coins between the internal hopper (1) and the coin storage tank (2) for adjusting a quantity of coins held in the internal hopper (1).

24 Claims, 9 Drawing Sheets

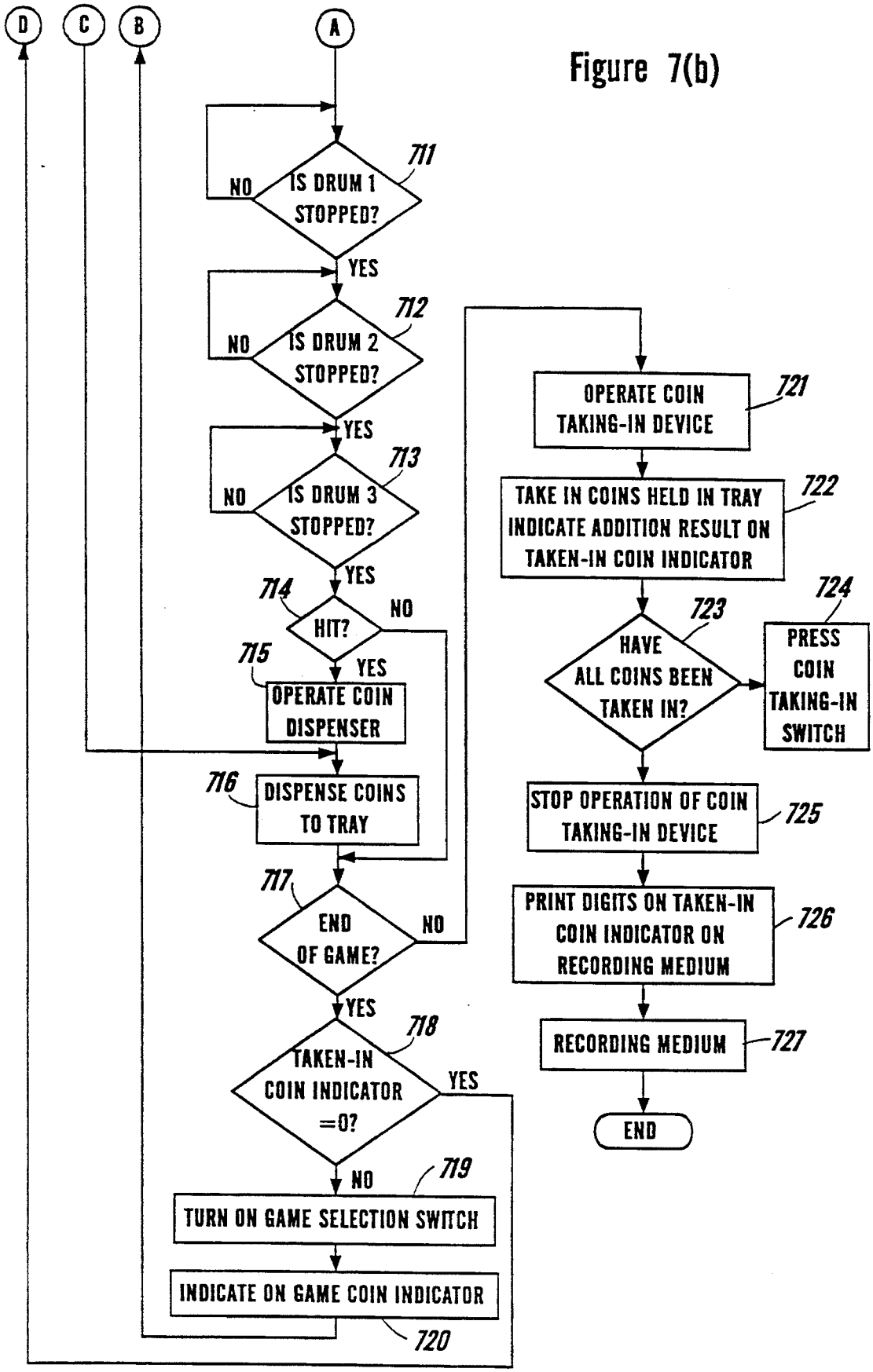
D
C
B
A
Figure 7(b)
711
IS DRUM 1 STOPPED?
NO
YES
712
IS DRUM 2 STOPPED?
NO
YES
713
IS DRUM 3 STOPPED?
NO
YES
714
HIT?
NO
YES
715
OPERATE COIN DISPENSER
716
DISPENSE COINS TO TRAY
717
END OF GAME?
NO
YES
718
TAKEN-IN COIN INDICATOR =0?
YES
NO
719
TURN ON GAME SELECTION SWITCH
INDICATE ON GAME COIN INDICATOR
720
721
OPERATE COIN TAKING-IN DEVICE
722
TAKE IN COINS HELD IN TRAY INDICATE ADDITION RESULT ON TAKEN-IN COIN INDICATOR
723
HAVE ALL COINS BEEN TAKEN IN?
724
PRESS COIN TAKING-IN SWITCH
725
STOP OPERATION OF COIN TAKING-IN DEVICE
726
PRINT DIGITS ON TAKEN-IN COIN INDICATOR ON RECORDING MEDIUM
727
RECORDING MEDIUM
END

SLOT MACHINE HAVING UNITARY COIN RESTORATION SYSTEM

TECHNICAL FIELD

This invention relates to a slot machine having unitary coin restoration system wherein a given quantity of coins can always be held while coins are caused to flow back into an internal hopper of the slot machine.

TECHNICAL BACKGROUND

For example, each of conventional slot machines disposed in a slot machine dome has an internal hopper through which coins are dispensed, entered coins are accepted, or coins paid out to a customer are accepted for circulation.

However, the capacity of the internal hopper is limited from the viewpoint of the size of the slot machine. Thus, if the customer has coins for himself or herself, the coins in the slot machine may increase. Also, the customer may take home coins that are paid out, in which case the number of coins in the slot machine decreases. When the coins in the slot machine increase or decrease substantially, the slot machine must be stopped in order to take out coins from the internal hopper or replenish the internal hopper with coins. This job causes personnel in the gaming house a lot of trouble and is inconvenient to the customer. Moreover the availability of the slot machine deteriorates.

DISCLOSURE OF INVENTION

It is therefore an object of the invention to provide a slot machine designed so that the number of coins in an internal hopper in the slot machine can always be maintained at a given quantity.

To this end, according to the invention, there is provided a slot machine having unitary coin restoration system comprising a game execution system for executing a game, a coin dispensing/adjustment system for dispensing coins and making adjustment, and a coin handling system, characterized in that the coin handling system comprises:

an internal hopper for dispensing coins and holding coins taken in from the outside;

a coin storage tank having a capacity larger than that of the internal hopper; and an adjustment mechanism for moving coins between the internal hopper and the coin storage tank for adjusting a quantity of coins held in the internal hopper.

The coin storage tank can be disposed under the internal hopper.

The adjustment mechanism can comprises an overflow passage for introducing coins exceeding an upper quantity limit in the internal hopper into the coin storage tank and a transport mechanism for transporting coins stored in the coin storage tank to the internal hopper.

The adjustment mechanism can further include a lower limit sensor for detecting that the internal hopper holds a lower limit quantity of coins and an upper limit sensor for detecting that the internal hopper holds an upper limit quantity of coins in the internal hopper.

The adjustment mechanism can further include a controller for controlling driving of the transport mechanism.

The controller can have means for reading an output of the lower limit sensor in the internal hopper, and as a result of the lower limit sensor detecting that the quantity of coins held in the internal hopper has reached a lower limit, driving the transport mechanism, and for reading an output of the upper limit sensor and as a result of the upper limit sensor detecting that the quantity of coins held has reached an upper limit, stopping the driving of the transporter.

The adjustment mechanism can further include a lower limit sensor for detecting that the coin storage tank is holding a number of coins that is at a lower limit and an upper limit sensor for detecting that the coin storage tank is holding a number of coins that is at an upper limit.

The controller can further include means for reading an output of the lower limit sensor in the coin storage tank, and as a result of the lower limit sensor detecting that the quantity of coins stored in the coin storage tank has reached a lower limit, outputting information indicating that the coin quantity is insufficient, and for reading an output of the upper limit sensor and as a result of the upper limit sensor detecting that the quantity of coins stored has reached an upper limit, outputting information indicating that the coin quantity is excessive.

The adjustment mechanism can further include a condition display for displaying information indicating conditions of the slot machine.

The adjustment mechanism can further include a proper quantity sensor for detecting that the coin storage tank stores a proper quantity of coins in the coin storage tank.

The adjustment mechanism can further include a shutter for regulating discharge of coins from the coin storage tank and a means of driving the shutter.

In this case, the controller can further include means for reading an output of the lower limit sensor in the internal hopper, and as a result of the lower limit sensor detecting, that the quantity of coins held in the internal hopper has reached a lower limit, driving the shutter so as to open and reading an output of the upper limit sensor, and a result of the upper limit sensor detecting that the quantity of coins held has reached an upper limit, driving the shutter so as to close.

Therefore, if the coins in the internal hopper increase or decrease depending on the slot machine condition, the internal hopper can always hold a given quantity of coins by restoring excessive coins to the coin storage tank having a larger capacity than the internal hopper or supplying coins from the coin storage tank via the transport mechanism to the internal hopper. Also, coins can be efficiently circulated between the internal hopper and the large-sized coin storage tank under the internal hopper, and coins can be sent to and received from a cashbox at the end of a slot machine dome, enabling players to play games without stopping the operation of each slot machine.

BEST MODE FOR CARRYING OUT THE INVENTION

Figure 1:
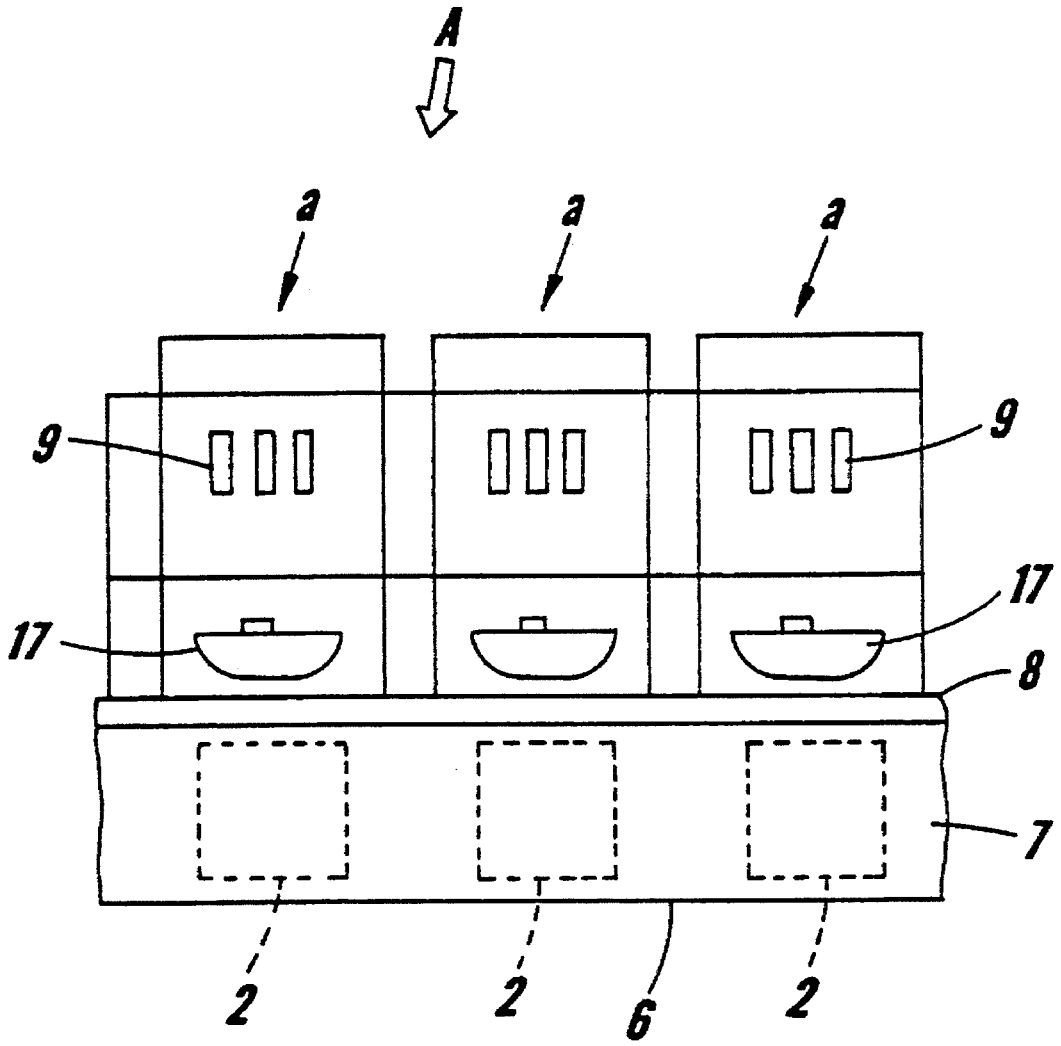
FIG. 1 is a front view showing a part of a slot machine dome where slot machines according to the invention are placed.

FIG. 1 shows a part of a slot machine dome where slot machines according to the invention are placed. As shown in FIG. 1, a slot machine dome A has a plurality of slot machines placed in a row. Normally, two slot machine rows are arranged facing in opposite directions to make up one slot machine dome A. FIG. 1 shows only one row.

The slot machine comprises a lower panel 7 called a baseboard and a top board 8 placed on top of the lower panel 7. As can be seen, a plurality of slot machine main unit cabinets a are placed on the top board 8. Tanks 2 for storing coins are placed under the top board 8.

Figure 2:
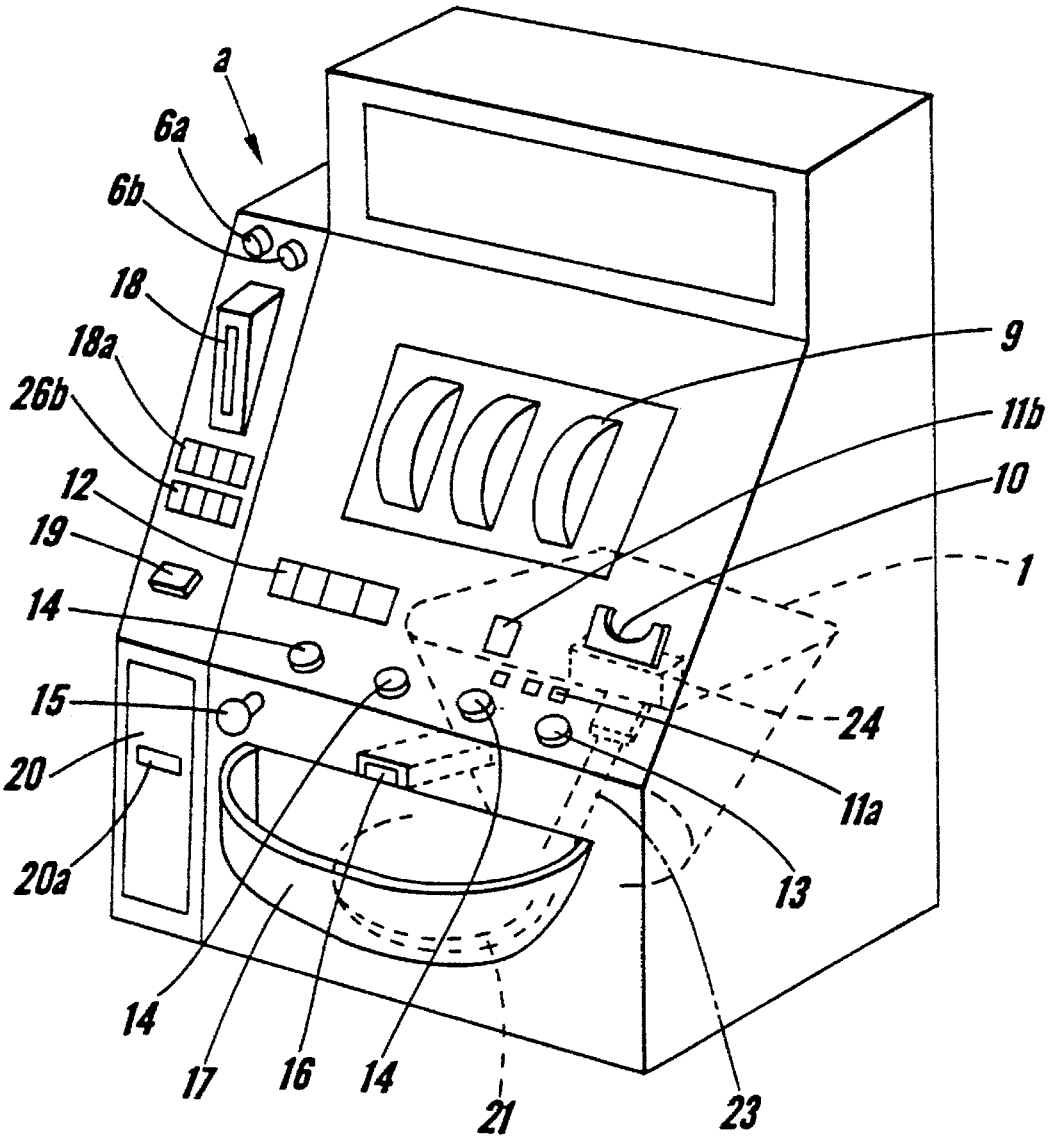
FIG. 2 is an illustration showing, the structure of a main unit cabinet in an embodiment of the slot machine of the invention.
Figure 3:
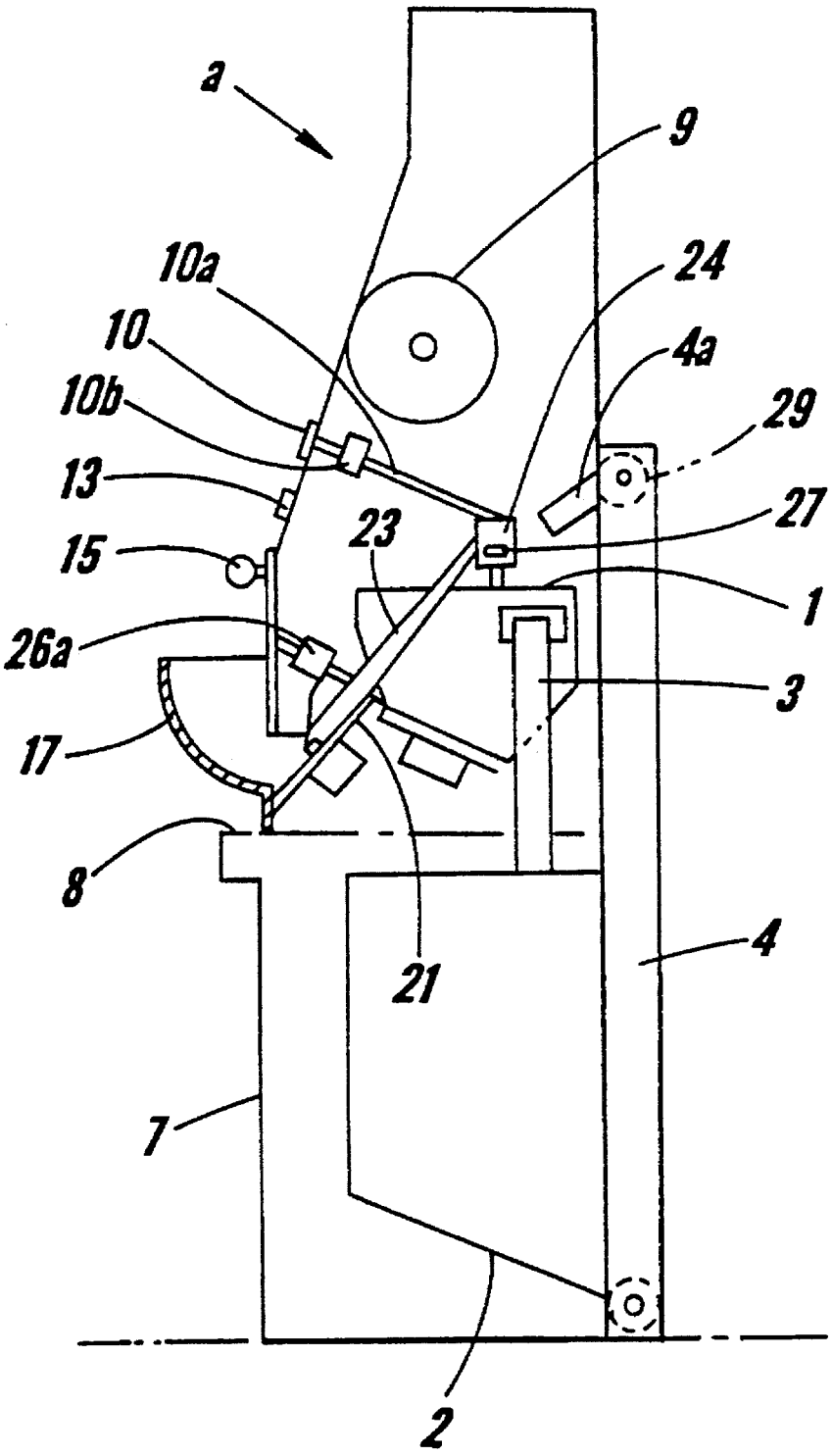
FIG. 3 is an elevational view showing the internal structure of the embodiment of the slot machine of the invention.
Figure 4:
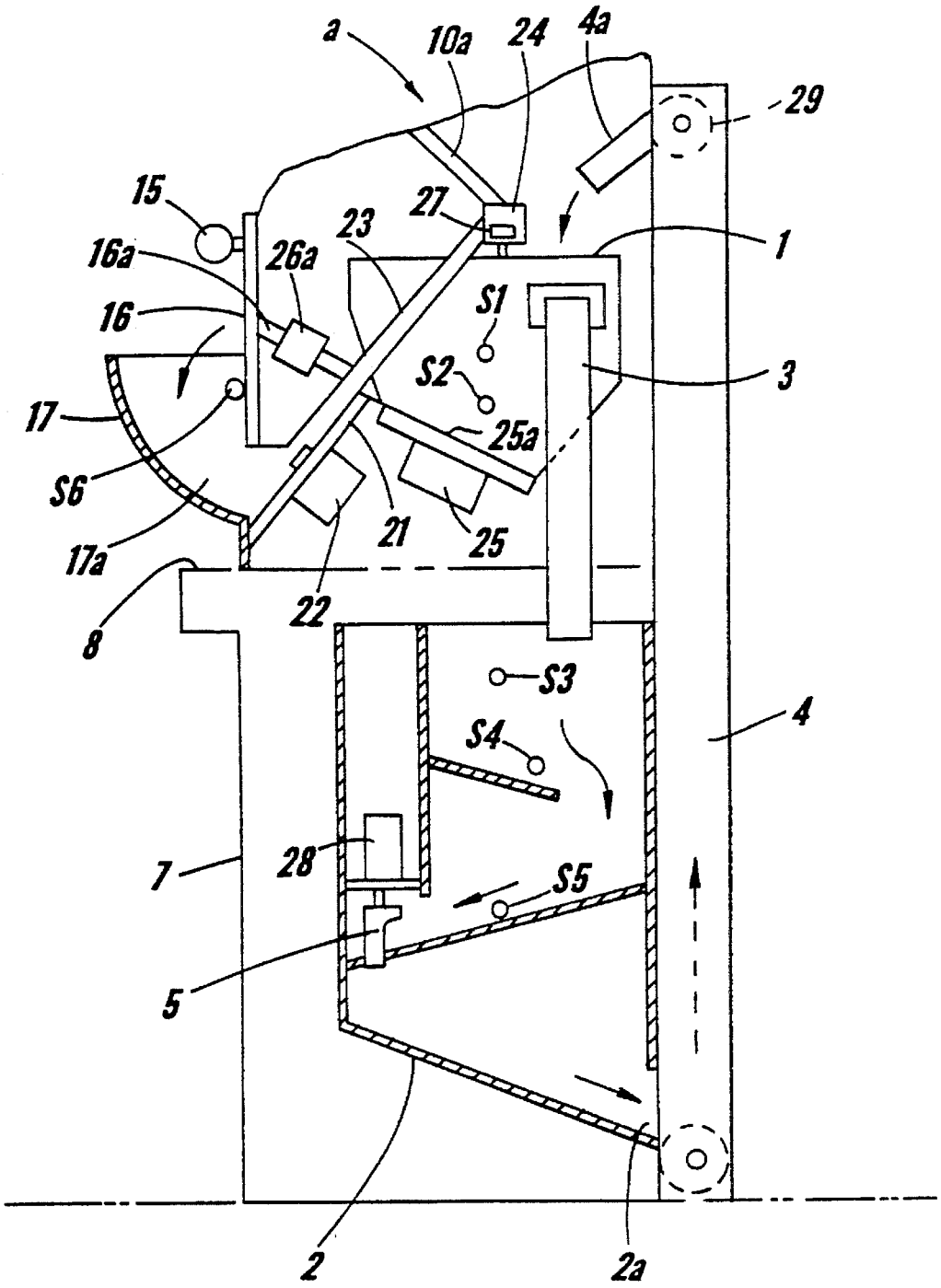
FIG. 4 is an elevational view showing in more detail the internal structure of the embodiment.

The structure of an individual slot machine is shown in FIGS. 2, 3, and 4. The slot machine in the embodiment has a game execution system, which is a mechanism for executing games, a coin dispensing/adjustment system for dispensing coins to play a game and making an adjustment, a coin handling system for dispensing, taking in, storing, transporting, etc., coins in the slot machine, and a controller for controlling the operation of these systems.

The components belonging to the game execution system are mainly situated in the upper part of the slot machine main unit cabinet a. The components belonging to the coin dispensing/adjustment system are mainly located in the side of the slot machine main unit cabinet a. Some parts of the coin handling system are located in the main unit cabinet a and others are located in the outside of the main unit cabinet a. The slot machine is separated into the game execution system, the coin dispensing/adjustment system, and the coin handling system, for ease of explanation; they are not limited to either such separation or names.

The game execution system comprises three rotating drums 9 each having a symbol pattern on its circumference, a start lever 15, for instructing the rotating drums 9 to rotate, and stop switches 14, for stopping rotation of the rotating drums 9, on the front of the cabinet a. Also, game selection switches 11*a* for specifying how to make a bet and a game coin indicator 11*b* for indicating the number of coins required for a game in response to the specification of the game selection switches 11*a* are installed on the front of the main unit cabinet a.

Further, although not shown in FIGS. 1–4, the cabinet a contains a drive 9*a* of the rotating drums 9, a win detector 9*b* for detecting a winning condition, and a controller corresponding to the switches and the drive. (See FIG. 5.)

In the embodiment, the stop switches 14 are provided corresponding to the rotating drums 9 on a one-to-one basis.

Rotation of all rotating drums may be stopped with only one stop switch or may be stopped with a timer or the like after a given time has elapsed without any stop switches being installed.

The coin dispensing/adjustment system comprises a bill slot 18 for entering bills, a bill validator (see FIG. 5) being disposed in the inside thereof for validating bills, an amount indicator 18*a* responsive to the validation result of the bill validator for indicating the amount of money in response to denominations of the entered bills, amount specification switches 6*a* and 6*b* for specifying the dispensed amount of coins, an adjustment switch 19 for instructing when a game is over and an adjustment of the entered amount and coins is made, and a recording medium issuer 20 for issuing a recording medium on which the adjustment result is recorded. The recording medium issuer 20 issues a magnetic card, a, receipt, or the like as a recording medium, and ejects the recording medium through an ejection slot 20*a*. In the embodiment, a magnetic card is used.

The amount specification switches 6*a* and 6*b* are provided corresponding to the amount of money, such as 10$ and 20$, for example.

The coin handling system has coin storage portions of an internal hopper 1 for holding coins in the main unit cabinet a, a coin storage tank 2 being located under the main unit cabinet a for storing coins, an overflow coin passage 3 for introducing coins overflowing from the internal hopper 1 into the coin storage tank 2, and a coin lift 4 for taking in coins from an entry port 2*a* on the bottom of the coin storage tank 2, transporting them upward, and discharging the coins into the internal hopper 1 through a discharge port 4*a*.

The internal hopper 1 has a storage capacity of at least as many coins as a total of the number of coins dispensed upon specification of the maximum amount of money and the assumed number of coins paid out to a player for a winning game play. The coin storage tank 2 is formed to be such a size its to have a storage capacity of a quantity of coins amounting to about four times the number of coins held in the internal hopper 1, for example. In the embodiment, about twice the number of coins held in the internal hopper 1 are previously stored in the coin storage tank 2. The coin storage tank 2 is provided with a rotatable shutter 5 and a drive motor 28 for rotating the shutter 5.

The internal hopper 1 and the coin storage tank 2 have level sensors for detecting the quantity of coins held therein. As the level sensors, the internal hopper 1 hits an upper limit sensor S1 being located at the position at which the quantity of coins held therein reaches the upper limit for detecting that coins are held to the position and a lower limit sensor S2 being located at the position at which the quantity of coins held therein reaches the lower limit for detecting that the held coins are reduced to the position. The coin storage tank 2 has an upper limit sensor S3 being located at the position at which the quantity of coins held therein reaches the upper limit for detection, that coins are held to the position, a proper quantity sensor S4 being located at the position at which the quantity of coins held therein becomes proper for sensing that the held coins reaches the position, and a lower limit sensor S5 being located at the position at which the quantity of coins held therein reaches the lower limit for detecting that the held coins are reduced to the position.

These sensors S1–S5 are made of photoelectric sensors, for example. Specifically, light emitting and receiving elements are located facing each other to constitute the sensor. That is, a coin existing between the light emitting and receiving elements prevents light of the light emitting element from being incident on the light receiving element, thus the presence of the coin can be sensed. Output signals of the sensors S1–S5 are sent to the controller described below (see FIG. 5).

The coin lift 4 has a lift mechanism (not shown) for transporting coins upward and a drive motor 29 for driving the lift mechanism. The drive motor 29 operates in response to an instruction from the controller described below.

The coin handling system also has a mechanism for paying out or dispensing coins and a mechanism for taking in coins from the outside.

The coin dispensing mechanism consists of a coin dispenser 25*a* located slantwise on the bottom of the internal hopper 1, a motor 25 for driving the coin dispenser 25*a*, a dispensing passage 16*a* having a front end used as a coin dispensing port 16 located on the front of the main unit cabinet a for guiding coins sent from the coin dispenser 25*a* to the dispensing port 16, and a tray 17 being located below the dispensing port 16 for holding dispensed coins.

A dispensing sensor 26*a* for counting dispensed coins is installed at an intermediate point on the dispensing passage 16*a*. An output of the sensor 26*a* is sent to the controller described below. Also, a dispensed coin count indicator 26*b* is provided below the amount indicator 18*a* of the main unit cabinet a for indicating the counting result of the dispensing sensor 26*a*. A signal for indicating the count is sent from the controller to the dispensed coin count indicator 26*b*.

The mechanism for taking-in coins from the outside consists of a coin taking-in device 21 being located in the interior of an opening 17*a* near the bottom of the tray 17 for taking in coins from the tray 17 and sending them to the internal hopper 1, a motor 22 for driving the coin taking-in device 21 a coin taking-in passage 23 for introducing the coins sent from the coin taking-in device 21 into the internal hopper 1, a coin selector 24 being located at an intermediate point on the coin taking-in passage 23 for selecting taken-in coins a taking-in sensor 27 for counting the selected coins, a taken-in coin indicator 12 for indicating the counting result of the taking-in sensor 27, and a coin slot 10 being located on the front of the main unit cabinet a into which coins are entered.

The coin slot 10 is linked with an entered coin passage 10*a* for introducing entered coins into the coin selector 24.

Installed in the upper portion of the interior of the tray 17 is an upper limit sensor S6 being located at the position at which the quantity of coins held in the tray 17 reaches the upper limit for sensing that coins are held to the position. An output of the sensor S6 is sent to the controller. Like the sensors S1–S5, a photoelectric sensor can be used as the sensor S6, for example.

Figure 5:
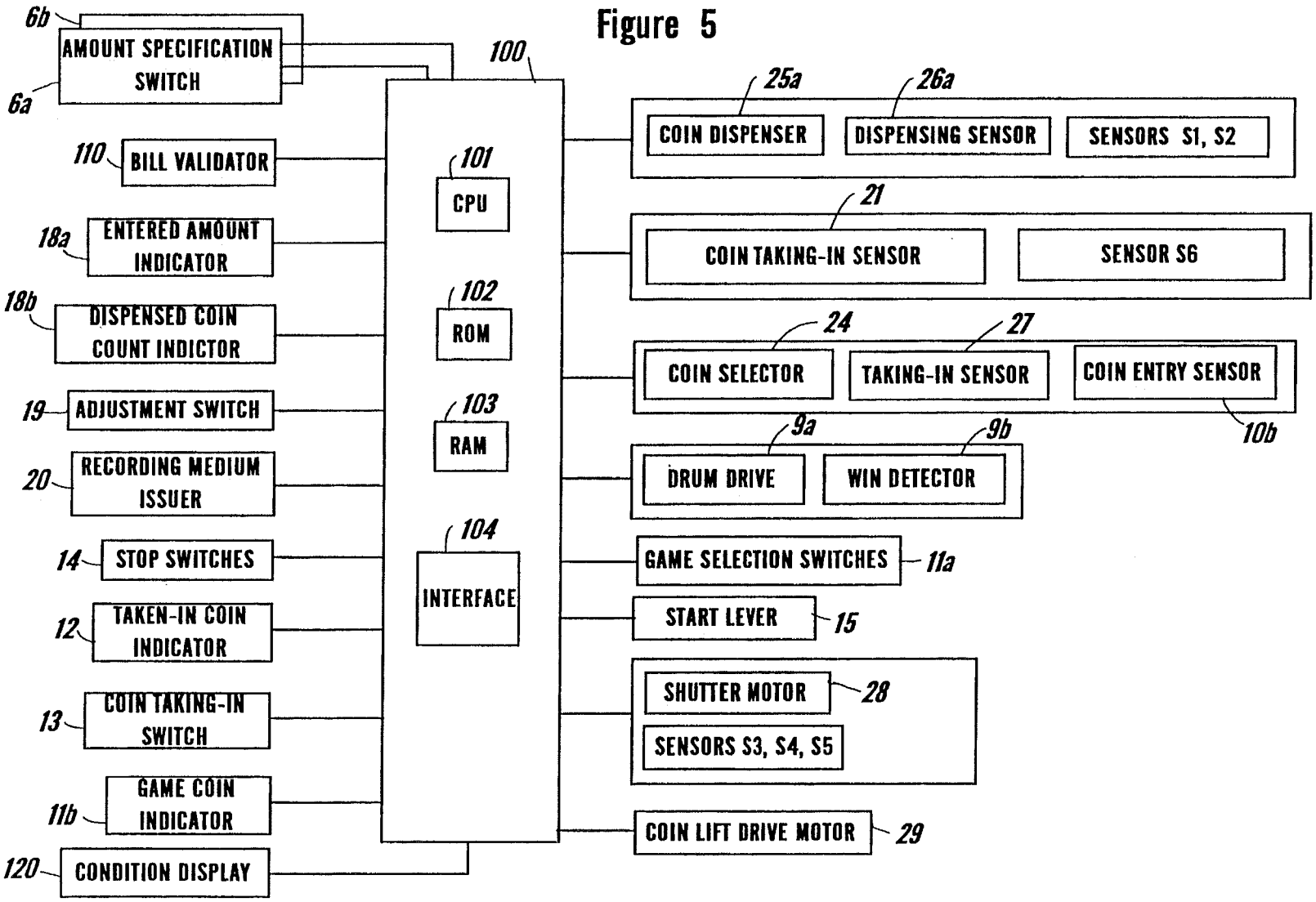
FIG. 5 is a block diagram showing the: configuration of a hardware system of a controller used with the embodiment of the invention.

The controller is configured, for example, as shown in FIG. 5. That is, the controller in the embodiment is provided by a computer system 100 which has a central processing unit (CPU) 101 which executes a control operation in response to previously stored programs, a read-only memory (ROM) 102 for storing the operation programs of the CPU 101 and data such as constants and parameters required for control, a random access memory (RAM) 103 for temporarily storing input signals, output signals, operation results, etc., and an interface 104. The CPU operation programs include programs for executing flowcharts shown in FIGS. 6–8, for example.

The bill validator 110, the amount specification switches 6*a* and 6*b*, the entered amount indicator 18*a*, the dispensed coin count indicator 18*b*, the adjustment switch 19, the recording medium issuer 20, the stop switches 14, the taken-in coin indicator 12, the coin taking-in switch 13, and the game coin indicator 11*b* are connected via the interface 104, to the controller. Also, the coin dispenser 25*a*, the dispensing sensor 26*a*, the sensors S1–S6, the coin taking-in device 21, the coin selector 24, the taking-in sensor 27, the drum drive 9*a*, the win detector 9*b*, the game selection switches 11*a*. the start lever 15, the shutter motor 28, and the coin lift drive motor 29 are connected via the interface 104 to the controller.

Further, a condition display 120 for displaying, conditions of the slot machine such as a coin hold condition is connected to the controller 100.

Figure 6:
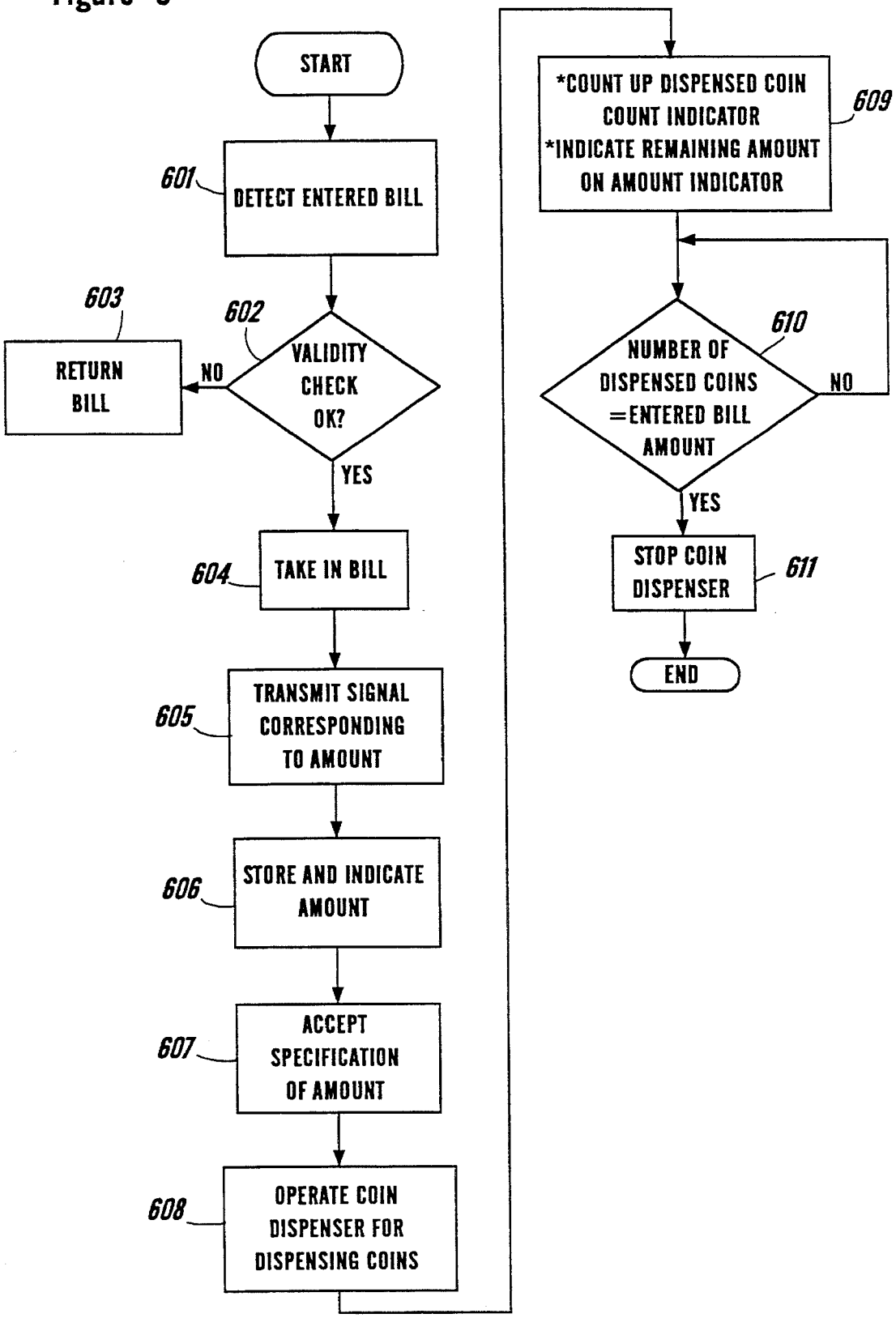
FIG. 6 is a flowchart showing the dispensing operation of a coin dispensing/adjustment system of the controller in the embodiment of the invention.
Figure 7A:
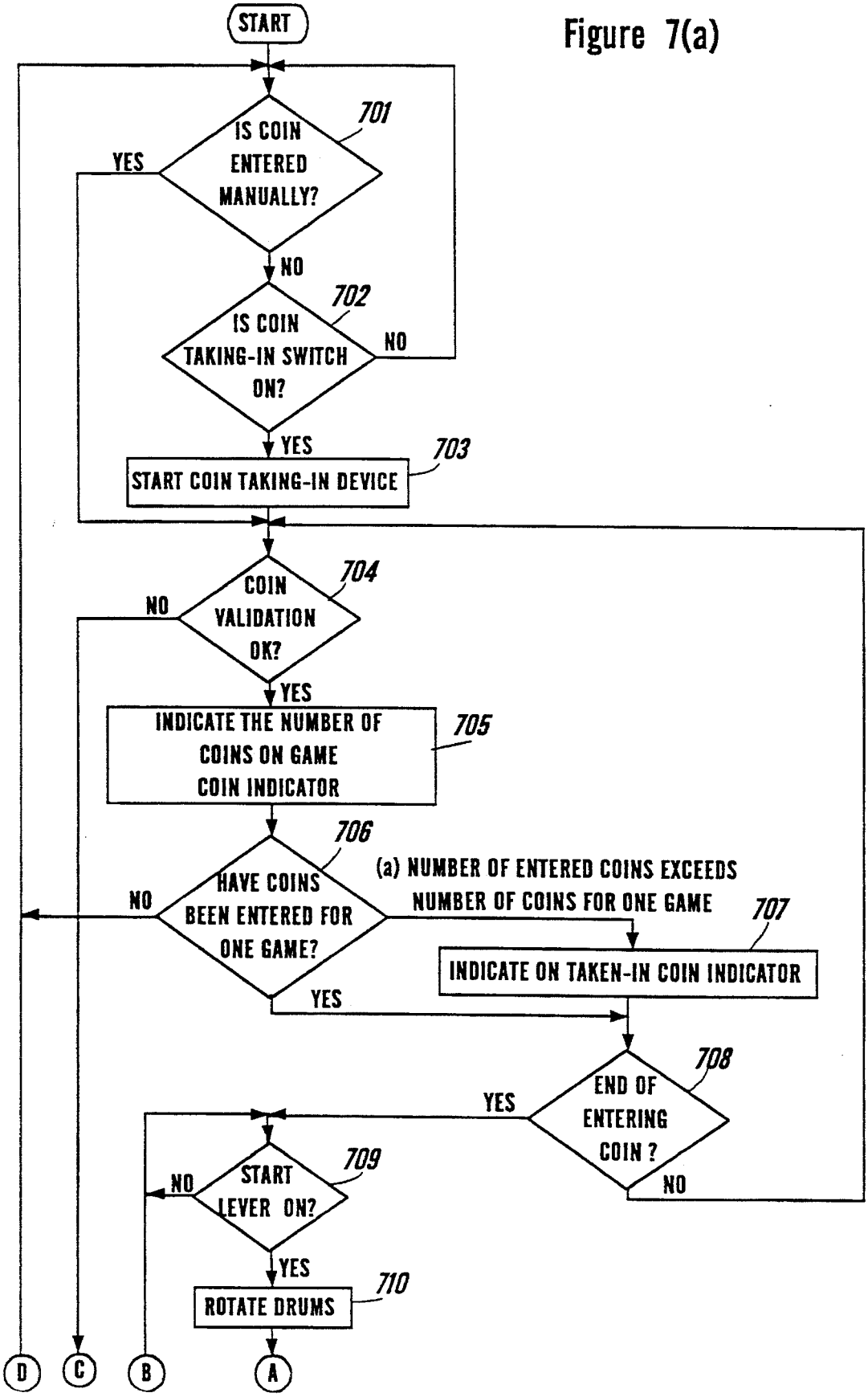
FIG. 7 is a flowchart showing the operation of a game execution system and the adjustment operation of the coin dispensing/adjustment system of the controller in the embodiment of the invention.
Figure 8:
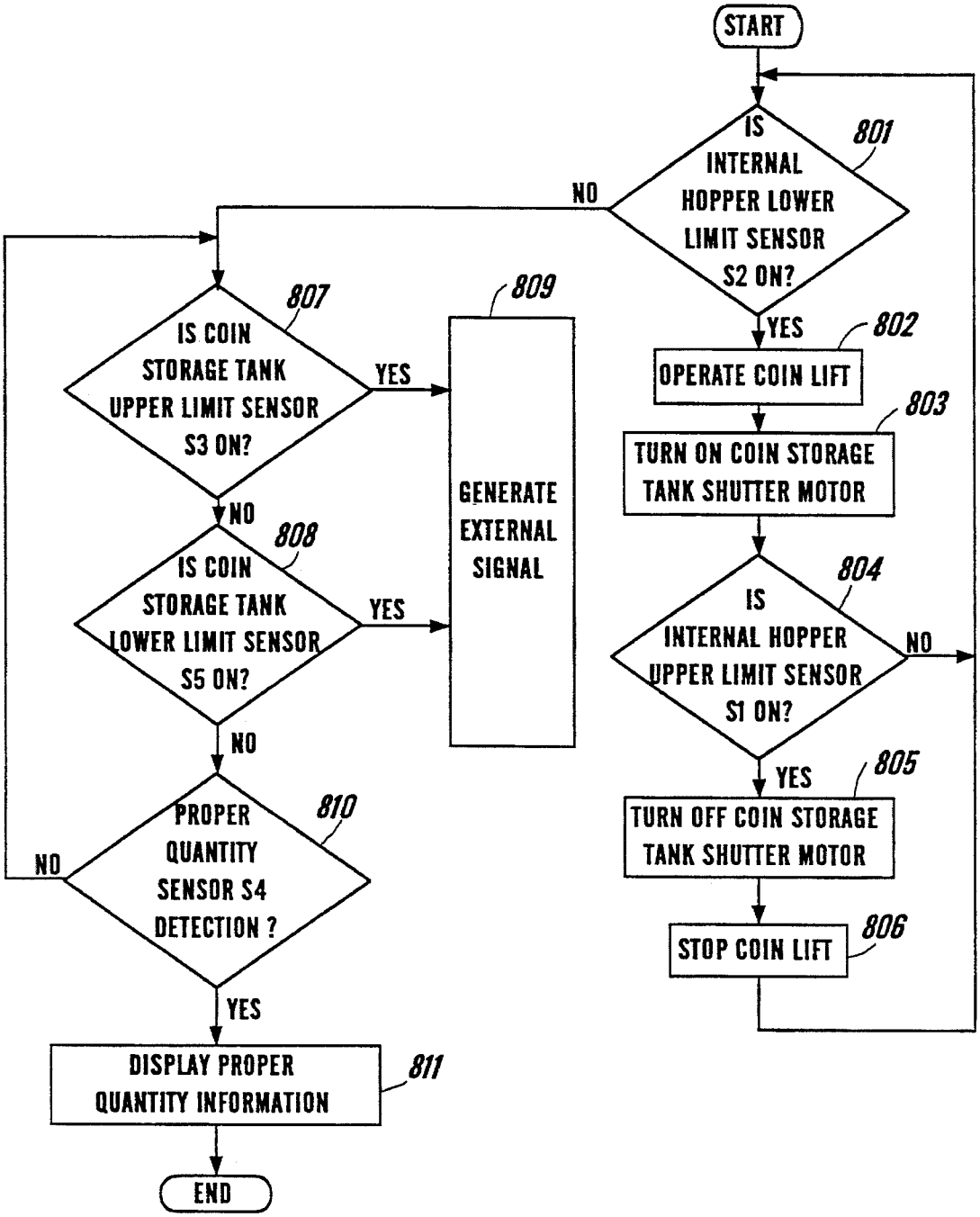
FIG. 8 is a flowchart showing the controller operation as a coin handling system in the embodiment of the invention.

Next, the operation of the embodiment will be described in conjunction with flowcharts in FIGS. 6–8.

First, the operation of dispensing coins to be used for gaming when a bill is entered will be discussed in conjunction with the flowchart shown in FIG. 6.

The bill validator 110 checks to see if a bill is entered through the bill slot 18 at step 601. When sensing that a bill is entered, the bill validator 110 starts a validation function. That is, while drawing the entered bill into the slot machine, the bill validator 110 detects the denomination of the bill and checks whether or not the bill is valid at step 602. If the bill is invalid, the bill validator 110 returns the bill to the slot 18 at step 603. If the bill is valid, the bill validator 110 takes it inside the slot machine and sends a signal corresponding to the amount of the detected denomination at step 605. The operation of the bill validator 110 is now complete.

When receiving the information indicating the entered amount of the bill from the bill validator 110, the controller 100 stores it in the RAM 103 and also sends it to the entered amount indicator 18*a* for indicating the entered amount at step 606. The controller 100 checks which of the amount specification switches 6*a* and 6*b* is pressed, and accepts specification of the amount corresponding to the pressed switch at step 607. If the entered amount matches the lowest amount of the money specification switch, the amount may be assumed to be specified without receiving specification of the amount specification switch 6*a*, 6*b*, and the operation can advance to subsequent steps.

When accepting specification of the amount, the controller 100 starts the motor 25 for driving the coin dispenser 25*a*, thereby dispensing coins in the internal hopper 1. That is, coins in the internal hopper 1 are transported through the coin dispensing passage 16*a* to the coin dispensing port 16 for dispensing or paying out coins of the specified amount to the tray 17 at step 608.

At this time, the number of dispensed coins is counted by the dispensing sensor 26*a* installed on the coin dispensing passage 16*a*. The count of the dispensing sensor 26*a* is sent to the controller 100. Whenever one coin is dispensed, the controller 100 counts up the indication on the dispensed coin count indicator 18*b* and at the same time, subtracts one coin from the entered amount stored in the RAM 103. Then, the controller 100 sends the remainder to the amount indicator 18*a* for indicating the remaining amount at step 609.

Then, the controller 100 determines whether or not the count of the dispensing sensor 26*a* reaches the number of dispensed coins equivalent to the specified amount at step 610. When the count of the dispensing sensor 26*a* reaches the number of dispensed coins equivalent to the specified amount, the controller 100 stops the coin dispenser 25*a* at step 611.

Thus, the remaining amount is finally indicated on the amount indicator 18*a* and the number of dispensed coins corresponding to the entered amount is indicated on the dispensed coin count indicator 18*b*.

Preparation for a game is now complete and a game is started.

In the embodiment, three methods of entering coins into the slot machine are available, one of which is executed as desired by a game player. Of course, only one or two methods may be made available.

The controller 100 monitors the operation of the coin entry sensor 10*b* for determining whether or not coins are manually entered through the coin slot 10 at step 701. This is a way in which a player manually enters coins held in the tray 17 one at a time into the coin slot 10 and plays a game after entering a predetermined number of coins. Normally, a player plays a game by handling the start lever 15 after entering one to three coins.

When coins are not manually entered, the controller 100 checks to see if the coin taking-in switch 13 is turned on for determining whether or not a coin taking-in instruction is given at step 702. If a coin taking-in instruction is given, the controller 100 starts the motor 22 of the coin taking-in device 21 for operating the coin taking-in device 21 at step 703. The coin taking-in device 21 takes in coins held in the tray 17 and introduces them to the coin selector 24 via the coin taking-in passage 23.

The coins entered through the coin slot 10 or the coins taken in by the coin taking-in device 21 are checked for validity by the coin selector 24 at step 704. If the coin is valid, it is taken into the inside of the internal hopper 1. At this time, the taking-in sensor 27 counts the number of coins sent to the hopper. The counting result is sent to the controller 100, which in turn sends the information indicating the counting result to the game coin indicator 11 for indicating the count at step 705.

The controller 100 determines whether or not the count of the sensor 27 exceeds the number of coins used for one game at step 706, and if the former exceeds the latter, sends the excessive count to the taken-in coin indicator 12 for indicating the value at step 707.

In the meantime, the controller 100 checks whether or not a coin has been manually entered and whether or not the coin taking-in switch 13 has been further turned on for driving the coin taking-in device 21 at step 708. If not, the controller 100 judges that the entering of coins ends, and advances to step 709. In contrast, if a coin has been manually entered or the switch 13 has been turned on, the controller 100 judges that entering of coins continues, and returns to step 704.

When coins are entered for just one game, the controller 100 advances to step 708 and checks whether or not the entering of coins ends, as above.

On the other hand, when the number of entered coins is insufficient for one game, the controller 100 returns to step 701.

In this description, it is assumed that the number of coins for one game is three.

If the entered coin is invalid, it is returned to the tray 17 through a return passage (not shown).

Next, the controller 100 checks to see if the start lever 15 is operated at step 709, and if it is operated, starts the drum drive 9*a* for rotating the rotating drums 9 at step 710. The controller 100 checks to see if the stop switch 14 for each drum 9 is turned on, and if the stop switch 14 is turned .on, stops the drum drive switch corresponding thereto for stopping rotation of the corresponding rotating drum 9. Then, the controller 100 checks the rotation stop conditions of the drums to see if a hit is made, namely, if the player wins the game at steps 711–714. Whether or not the game is won is determined by the combination of symbol patterns on the drums at this time. The controller 100 determines it by a combination of rotation angles of the drums, for example.

If the player wins the game, the controller 100 operates the coin dispenser 25*a* for dispensing or paying out coins to the tray 17 at steps 715 and 716. At this time, the dispensing sensor 26*a* counts the number of dispensed or paid-out coins. The value is sent to the dispensed coin count indicator 18*b* so as to be indicated. The indication is cleared to zero when the player handles the start lever 15 after entering game coins.

In the example, the drums 9 are stopped when the player handles their corresponding stop switches 14. However, the invention is not limited to this method. For example, one switch may be used to stop every drum or the drums may be stopped one at a time automatically when a given time has elapsed.

Next, the controller 100 checks whether or not the adjustment switch 19 is turned on, and if the adjustment switch 19 is not turned by the time a given time elapses, determines that another game is to be started at step 717.

The controller 100 checks whether or not the value on the taken-in coin indicator 12 is 0 at step 718 by referring to the corresponding area in the RAM 103. If it is not 0, the player can turn on any of the game selection switches for starting another game at step 719. Then, the number of coins required for one game is indicated on the game coin indicator 11 at step 720. That is, the number of coins indicated on the game coin indicator 11 is subtracted from the value on the taken-in coin indicator 12 and the result is indicated thereon. Then, control returns to step 709. The player can repeat games until the indication reaches zero.

On the other hand, if the adjustment switch 19 is turned on at step 717, the controller 100 operates the coin taking-in device 21 for taking in coins held in the tray 17 at step 721. At this time, the coin selector 24 checks the coins for validity and the taking-in sensor 27 counts the number of taken-in coins. The coin count is read into the controller 100, which then sends it to the taken-in coin indicator 12 so as to be indicated at step 722.

If the player again operates the coin taking-in switch 13 at a proper timing while coins are taken in, the operation of the coin taking-in device 21 can be stopped. Thus, when coins are being taken in, the player can also operates the switch 13 to leave some coins in the tray 17 and move to another gaming machine to play a game with the remaining coins at steps 723 and 724.

When all coins in the tray 17 have been taken in or when the player operates the coin taking-in switch 13 in the meantime, the controller 100 stops driving the coin taking-in device 21 at step 725. Then, the controller 100 prints out the digits indicated on the-taken-in coin indicator on a recording medium at steps 726 and 727. Receipts, cards, etc., are used as the dispensed recording media. In addition to the number of coins paid out to the player, the gaming house name, dates, time, security code, and bar code data are printed on each recording medium, enabling the player to check the data for himself or herself and the data to be read through a machine.

The player brings the card to a changer (prize exchange counter or window) in order to exchange it for cash (prize).

The cash paid out to the player at this time is mainly bills, and coins are paid out for the fractional amounts of money. Thus, unlike the conventional exchange system requiring that the player should carry heavy coins, the system of the invention enables the player to play games comfortably.

Since coins as game play media are used in such a system, basically if a given quantity of coins is stored in the gaming machine, it will suffice. In fact, as coins are brought into the gaming machine from other gaming machines or are taken out from the gaming machine, the number of coins in the gaming machine increases or decreases.

Thus, when the quantity of coins held in the slot machine increases or decreases, the insufficient or excessive coin quantity may cause an error to occur in the slot machine operation. For example, if the coin quantity becomes insufficient, a specified quantity of coins cannot be dispensed and the dispensing stops before coins are dispensed completely, stopping the operation of the slot machine. On the other hand, if the coin quantity is too much, coins cannot be fully held in the slot machine and excessive coins overflow from the storage section or cause the slot machine to overload, causing a jam in the transport section. In either case, unless the coin quantity is appropriately adjusted, an error occurs, inconveniencing, customers and damaging to the profit of the gaming house.

For this reason, in the invention, apart from the internal hopper 1, there are provided the coin storage tank 2, for storing coins and functioning as a coin quantity buffer, and the coin lift 4 and the overflow passage 3 for functioning as a coin quantity adjustment mechanism for moving coins between the internal hopper 1 and the coin storage tank 2 for adjusting the quantity of coins in the internal hopper 1. Further, there are provided the sensors S1–S6 for sensing the coin quantity and the controller 100 for controlling adjustment of the coin quantity. These components make up a system for causing coins to flow back into the internal hopper 1 to adjust the coin quantity for each slot machine.

In the embodiment, coins of about twice the quantity in the internal hopper 1 are previously stored in the coin storage tank 2, which is provided with an additional space for further storing about twice as many coins as are in the internal hopper 1, whereby a shortage or excess of coins can be overcome. Further, the coin storage tank 2 contains the shutter 5 for adjusting a flow of coins so that coins flow into the coin lift 4 only when necessary. Therefore, if coins are taken out from the slot machine or are brought into the slot machine from other gaming machines, proper steps can be taken.

Next, the operation of such a system for adjusting the coin amount will be described in conjunction with FIG. 8.

The controller 100 monitors outputs of the sensors S1–S6 on given periods. The monitor routine is shown in FIG. 8. An interrupt may be caused in response to an output of each sensor S1, S2, S3, S5, S6 for processing.

When the coins in the internal hopper 1 fall below a certain quantity, the lower limit sensor S2 operates. The controller 100 checks whether or not the sensor S2 operates at step 801. If the sensor S2 operates, the controller 100 starts the motor 29 of the coin lift 4 for driving the coin lift 4 at step 802. Also, the controller 100 starts the shutter motor 28 in the coin storage tank 2 for opening the shutter 5 at step 803.

Thus, a proper quantity of coins in the coin storage tank 2 is dropped on the lower slant and introduced to the entry port 2*a*. The coin lift 4 lifts up the coins. The lifted-up coins are moved from the upper discharge port 4*a* to the internal hopper 1.

Next, the controller 100 checks the upper limit sensor S1 for operational state, and repeats the steps until the sensor S1 enters the operational state at step 804. When coins are supplied to the installation position of the sensor S1, the sensor S1 enters the operational state. Accordingly, the controller 100 drives the motor 28 of the shutter 5 in the coin storage tank 2 for shutting the shutter 5 to stop supplying the coins to the coin storage tank 2 at step 805. Also, the controller 100 stops the motor 29 of the coin lift 4 at step 806. At this time, the motor 29 may be operated for a given time with a timer (not shown) for discharging all coins in the coin lift 4 to the internal hopper 1.

Thus, a proper quantity of coins can always be held in the internal hopper 1.

The controller 100 also monitors the sensors S3–S5 installed in the coin storage tank 2.

First, the controller 100 checks the state of the upper limit sensor S3 at step 807. If the upper limit sensor S3 operates, the controller 100 outputs an alert signal, indicating that there are too many coins in the slot machine to the condition display 120 at step 809. When receiving the alert signal, the display 120 outputs a message and an alert sound in the embodiment for informing personnel in the gaming house that the condition has occurred because the condition means that the upper limit of the buffer function of the coin storage tank 2 is exceeded. Then, personnel in the gaming house can realize that it is necessary to take out a given quantity of coins from the coin storage tank for adjustment to a proper coin quantity, because there are too many coins in the slot machine.

The controller 100 checks the state of the lower limit sensor S5 at step 808. If the lower limit sensor S5 operates, the controller 100 outputs an alert signal, indicating that a shortage of coins occurs in the slot machine, to the condition display 120 at step 809. When receiving the alert signal, the display 120 outputs a message and an alert sound in the embodiment for informing personnel in the gaming house that the condition has occurred because the condition means that the lower limit of the buffer function of the coin storage tank 2 is exceeded. In this case, the coins in the slot machine are insufficient and personnel in the gaming house will supply a given quantity of coins from the outside.

The controller 100 checks the state of the proper quantity sensor S4 at step 810. The controller 100 determines that the current quantity of coins is large or small from the relationship between the operation state of the proper quantity sensor S4 and the operation state of the lower and upper limit sensors S5 and S3. That is, if the proper quantity sensor S4 is on and the upper limit sensor S3 is off, it indicates that the coin quantity is sufficient or more. If the proper quantity sensor S4 is off and the lower limit sensor S5 is off, it indicates that the coin quantity is deficient.

A change in the on/off state of the sensor S4 may be recorded and checked to ascertain a movement of the coin quantity in the slot machine. That is, if the proper quantity sensor S4 repeats the on and off state in a short period, it is observed that the coin quantity stays in the proper quantity range. If either the state where the quantity is sufficient or more or the state where the quantity is deficient is maintained for an extremely long period, it is observed that coins tend to be excessive or insufficient in the slot machine.

Then, in the embodiment, the controller 100 also displays information concerning the proper quantity sensor S4 on the condition display 120 at step 811.

Thus, in the invention, the coin quantity can be buffered and the handling quantity of coins in the slot machine can be adjusted. Therefore, the coin quantity can be automatically adjusted for each slot machine.

In the example, when the buffer capacity of the adjustment system is exceeded personnel in the gaming house are informed so that they can take proper steps. This point can be solved by providing a buffer function for adjusting the coin quantity in the entire slot machine dome. The buffer function can be provided by installing an additional coin storage tank in the slot machine dome and a transporter for transferring coins between each slot machine and the coin storage tank. The configuration can be provided by expanding the configuration for each slot machine of the invention.

The controller 100 handles the sensor S6 as follows: When a signal indicating an overflow condition is output from the sensor S6 in the tray 17, the controller 100 is interrupted. Accordingly, the controller 100 starts the motor 22 for driving the coin taking-in device 21 to take in a predetermined number of coins, and then stops it.

This operation prevents coins from overflowing from the tray 17. The number of taken-in coins is counted via the taking-in sensor 27 and is displayed on the taken-in coin indicator 12.

I claim:

1. A slot machine having unitary coin restoration system comprising a game execution system for executing a game, a coin dispensing/adjustment system for dispensing coins and making adjustment, a coin handling system, characterized in that said slot machine having unitary coin restoration system being provided with a controller for controlling operation of said game execution system, said coin dispensing/adjustment system, and said coin handling system, said coin handling system comprises:

a coin dispensing mechanism for dispensing coins from inside to outside of said slot machine;

a coin taking-in mechanism for taking in coins from outside to inside of said slot machine; and an internal hopper for holding coins, said coin dispensing mechanism having at least a coin dispenser for dispensing coins from said internal hopper and a tray for holding coins dispensed through said coin dispenser, said coin taking-in mechanism having a coin taking-in device for taking in coins from said tray to the inside of said slot machine, a taking-in sensor for counting the number of taken-in coins, and an upper limit sensor being located at an upper position of said tray for detecting coins held in said tray reaching an upper limit of holding coins and sending a detection signal to said controller, and that said game execution system comprises:

a game execution section for executing a game upon receipt of an instruction and stopping the game upon receipt of an instruction; and a coin taking-in switch for instructing said coin taking-in mechanism to take in coins required for execution of a game, said coin taking-in mechanism for taking in as many coins as required for a game upon receipt of a coin taking-in instruction from said coin taking-in switch, and that when a detection signal for detecting the quantity of coins held in said tray reaching an upper limit is input from said upper limit sensor, said controller operates said coin taking-in device for taking in a given quantity of coins to the inside of said slot machine and reads information indicating the number of taken-in coins counted by said taking-in sensor at that time.

2. The slot machine as claimed in claim 1 wherein said coin taking-in switch is connected to said controller, and wherein said coin taking-in mechanism receives the coin taking-in instruction from said coin taking-in switch via said controller.

3. The slot machine as claimed in claim 2 wherein said coin dispensing/adjustment system has an adjustment switch for accepting an input of an adjustment instruction when a game is over, and wherein when an adjustment instruction is input through said adjustment switch, said controller operates said coin taking-in device for taking in coins existing in said tray to the inside of the slot machine and reads information indicating the number of taken-in coins counted by said taking-in sensor at that time.

4. The slot machine as claimed in claim 2 wherein said coin handling system further includes:

a coin storage tank having a capacity larger than that of said internal hopper; and an adjustment mechanism for moving coins between said internal hopper and said coin storage tank for adjusting a quantity of coins held in said internal hopper, and wherein said adjustment mechanism comprises:

an overflow passage for introducing coins exceeding an upper quantity limit in said internal hopper into said coin storage tank;

a transport mechanism for transporting coins stored in said coin storage tank to said internal hopper;

a lower limit sensor for detecting that said internal hopper holds a lower limit quantity of coins in said internal hopper; and an upper limit sensor for detecting that said internal hopper holds an upper limit quantity of coins in said internal hopper.

5. The slot machine as claimed in claim 4 wherein said controller further has means for reading an output of said lower limit sensor in said internal hopper, and when said lower limit sensor detects that the quantity of coins held in said internal hopper reaches a lower limit, said means driving said transport mechanism, said means also reading an output of said upper limit sensor and when said upper limit sensor detects that the quantity of coins held reaches an upper limit, stopping the driving of said transporter.

6. The slot machine as claimed in claim 5 wherein said adjustment mechanism further includes a proper quantity sensor for detecting that said coin storage tank stores a proper quantity of coins in said coin storage tank.

7. The slot machine as claimed in claim 6 wherein said adjustment mechanism further includes a lower limit sensor for detecting that said coin storage tank stores a lower limit quantity of coins and an upper limit sensor for detecting that said coin storage tank stores an upper limit quantity of coins, in said coin storage tank.

8. The slot machine as claimed in claim 7 wherein said controller further includes means for reading an output of said lower limit sensor in said coin storage tank, and when said lower limit sensor detects that the quantity of coins stored in said coin storage tank reaches a lower limit, said means outputting information indicating that the coin quantity is insufficient, said means also reading an output of said upper limit sensor and when said upper limit sensor detects that the quantity of coins stored reaches an upper limit, outputting information indicating that the coin quantity is excessive.

9. The slot machine as claimed in claim 8 further including a condition display for displaying information indicating conditions of said slot machine, said condition display being connected to said controller.

10. The slot machine as claimed in claim 9 wherein said controller determines whether the current quantity of coins in said coin storage tank is large or small from a relationship between an operation state of said proper quantity sensor and an operation state of said upper and lower limit sensors.

11. The slot machine as claimed in claim 10 wherein said controller outputs information indicating an on or off state of said proper quantity sensor to said condition display for displaying it.

12. The slot machine as claimed in claim 5 wherein said adjustment mechanism further includes a shutter for regulating discharge of coins from said coin storage tank and a drive of said shutter, and wherein said controller further includes means for reading an output of said lower limit sensor in said internal hopper, and when said lower limit sensor detects that the quantity of coins held in said internal hopper reaches a lower limit, said means driving said drive of said shutter for opening said shutter, said means also reading an output of said upper limit sensor and when said upper limit sensor detects that the quantity of coins held reaches an upper limit, driving said drive for closing said shutter.

13. The slot machine as claimed in claim 3 wherein said coin taking-in mechanism further includes a taken-in coin indicator for indicating the number of taken-in coins counted by said taking-in-sensor.

14. The slot machine as claimed in claim 13 wherein said coin dispensing/adjustment system further includes:

a bill validator for at least validating a denomination of a bill entered from the outside of said slot machine;

an amount indicator for indicating an amount of money of the denomination validated by said bill validator; and an amount specification switch for accepting an input for specifying a dispensed amount of coins, said controller for instructing said coin dispenser to dispense as many coins as the number of coins equivalent to the dispensed amount specified through said amount specification switch.

15. The slot machine as claimed in claim 14 wherein said coin handling system further includes a dispensing sensor for counting coins dispensed through said coin dispenser, and wherein said controller includes:

means, whenever a coin is taken in for reading, a counting result of said taking-in sensor, adding the counting result to the number of coins taken in so far, and storing the addition result; and means, when coins are dispensed based on the number of taken-in coins, for subtracting the number of dispensed coins from the stored number of taken-in coins for updating the number of taken-in coins.

16. The slot machine as claimed in claim 7 wherein said controller includes means for reading an output of said lower limit sensor in said coin storage tank, and when said lower limit sensor detects that the quantity of coins stored in said coin storage tank reaches a lower limit, said means outputting information indicating that the coin quantity is insufficient, said means also reading an output of said upper limit sensor and when said upper limit sensor detects that the quantity of coins stored reaches an upper limit, outputting information indicating that the coin quantity is excessive.

17. The slot machine as claimed in claim 16 further including a condition display for displaying information indicating conditions of said slot machine, said condition display being connected to said controller.

18. The slot machine as claimed in claim 17 wherein said controller determines whether the current quantity of coins in said coin storage tank is large or small from a relationship between an operation state of said proper quantity sensor and an operation state of said upper and lower limit sensors.

19. The slot machine as claimed in claim 18 wherein said controller outputs information indicating an on or off state of said proper quantity sensor to said condition display in order to display it.

20. The slot machine as claimed in claim 19 wherein said coin storage tank is disposed under said internal hopper.

21. A slot machine having unitary coin restoration system comprising a game execution system for executing a game, a coin dispensing/adjustment system for dispensing coins and making adjustment, and a coin handling system, characterized in that said coin handling system comprises a coin dispensing mechanism for dispensing coins from inside to outside of said slot machine:

a coin taking-in mechanism for taking in coins from outside to inside of said slot machine;

an internal hopper for holding coins;

a coin storage tank having a capacity larger than that of said internal hopper; and an adjustment mechanism for moving coins between said internal hopper and said coin storage tank for adjusting a quantity of coins held in said internal hopper, said coin dispensing mechanism having at least a coin dispenser for dispensing coins from said internal hopper and a tray for holding coins dispensed through said coin dispenser, said coin taking-in mechanism having at least a coin taking-in device for taking in coins from said tray to the inside of said slot machine and a taking-in sensor for counting the number of taken-in coins, said adjustment mechanism comprising:

an overflow passage for introducing coins exceeding an upper quantity limit in said internal hopper into said coin storage tank;

a transport mechanism for transporting coins stored in said coin storage tank to said internal hopper;

a lower limit sensor for detecting that said internal hopper holds a lower limit quantity of coins in said internal hopper;

an upper limit sensor for detecting that said internal hopper holds an upper limit quantity of coins in said internal hopper; and a proper quantity sensor for detecting that said coin storage tank stores a proper quantity of coins in said coin storage tank, and that said game execution system comprises:

a game execution section for executing a game upon receipt of an instruction and stopping the game upon receipt of an instruction; and a coin taking-in switch for instructing said coin taking-in mechanism to take in coins required for execution of a game, said coin taking-in mechanism for taking in as many coins as required for a game upon receipt of a coin taking-in instruction from said coin taking-in switch.

22. The slot machine as claimed in claim 21 further including a controller for controlling operation of said game execution system, said coin dispensing/adjustment system, and said coin handling system, said coin taking-in switch being connected to said controller, said coin taking-in mechanism receiving the coin taking-in instruction from said coin taking-in switch via said controller.

23. The slot machine as claimed in claim 22 wherein said controller further has means for reading an output of said lower limit sensor in said internal hopper, and when said lower limit sensor detects that the quantity of coins held in said internal hopper reaches a lower limit, said means driving said transport mechanism, said means also reading an output of said upper limit sensor and when said upper limit sensor detects that the quantity of coins held reaches an upper limit, stopping the driving of said transporter.

24. The slot machine as claimed in claim 23 wherein said adjustment mechanism includes a lower limit sensor for detecting that said coin storage tank stores a lower limit quantity of coins and an upper limit sensor for detecting that said coin storage tank stores an upper limit quantity of coins in said coin storage tank.

* * * * *